US006651853B2

(12) United States Patent
Higgins et al.

(10) Patent No.: US 6,651,853 B2
(45) Date of Patent: Nov. 25, 2003

(54) BACKPACK FRAME, SUSPENSION, SEAT AND COT

(76) Inventors: Richard Higgins, 305 S. 9th St., Flagler Beach, FL (US) 32136; Rachel Higgins, 305 S. 9th St., Flagler Beach, FL (US) 32136

( * ) Notice: Subject to any disclaimer, the term of this patent is extended or adjusted under 35 U.S.C. 154(b) by 0 days.

(21) Appl. No.: 09/834,578

(22) Filed: Apr. 16, 2001

(65) Prior Publication Data

US 2002/0170932 A1 Nov. 21, 2002

(51) Int. Cl.[7] ..... A45F 4/02

(52) U.S. Cl. ..... 224/155; 224/156; 224/635; 224/637; 224/652

(58) Field of Search ..... 224/156, 633, 224/635, 637, 155, 153, 627, 628, 452

(56) References Cited

U.S. PATENT DOCUMENTS

| | | | | | |
|---|---|---|---|---|---|
| 41,418 | A | | 2/1864 | Abbott | |
| 2,133,717 | A | * | 10/1938 | Robes, Jr. | 224/635 |
| 2,316,456 | A | * | 4/1943 | Robes, Jr. | 224/635 |
| 2,456,253 | A | * | 12/1948 | Bushey | 224/635 |
| 2,517,757 | A | * | 8/1950 | Adlerstein | 224/635 |
| 2,964,222 | A | | 12/1960 | Rainwater | |
| 2,973,888 | A | | 3/1961 | Beardsley | |
| 3,158,299 | A | * | 11/1964 | Weir et al. | 224/635 |
| 3,233,803 | A | * | 2/1966 | Gray | 224/635 |
| 3,347,429 | A | * | 10/1967 | Ruth, Jr. | 224/635 |
| 3,464,607 | A | | 9/1969 | Grace | |
| 3,620,428 | A | | 11/1971 | Silverthorne | |
| 3,730,407 | A | | 5/1973 | Russell | |
| 3,733,017 | A | | 5/1973 | Plete | |
| 3,828,992 | A | | 8/1974 | Cerchione | |
| 3,860,157 | A | | 1/1975 | Richards | |
| 3,885,722 | A | | 5/1975 | Robertson | |
| 3,912,138 | A | | 10/1975 | Pava | |
| 4,056,857 | A | | 11/1977 | Quantz | |
| 4,074,839 | A | * | 2/1978 | Wood et al. | 224/635 |
| 4,169,550 | A | | 10/1979 | Williams | |
| 4,280,643 | A | * | 7/1981 | Cordova et al. | 206/225 |
| 4,511,071 | A | | 4/1985 | Curran | |
| 4,538,750 | A | | 9/1985 | Hanna | |
| 4,561,576 | A | * | 12/1985 | Lowe et al. | 224/579 |
| 4,694,979 | A | | 9/1987 | Ables | |
| 4,883,206 | A | | 11/1989 | Miller | |
| 4,883,207 | A | * | 11/1989 | McArthur | 190/113 |
| 4,885,812 | A | | 12/1989 | Lindner | |
| 4,947,498 | A | | 8/1990 | Van Boxtel | |
| 4,955,517 | A | | 9/1990 | Maresca | |
| 5,209,381 | A | | 5/1993 | Jay | |
| 5,732,867 | A | * | 3/1998 | Perkins et al. | 224/271 |
| 5,749,503 | A | * | 5/1998 | Wulf et al. | 190/18 A |
| 5,806,740 | A | * | 9/1998 | Carlson | 224/259 |
| 6,161,739 | A | * | 12/2000 | Bentzen | 224/153 |
| 6,202,907 | B1 | | 3/2001 | Higgins | |

* cited by examiner

*Primary Examiner*—Nathan J. Newhouse

(57) ABSTRACT

A backpack which includes a main bag, suspension system, frame, and additional miscellaneous parts. It combines the superior comfort of external frame backpacks, with the elegant style of internal frame backpacks. The frame is strapped within the main bag to create a semi-rigid surface against the back. The suspension system's shoulder harness is removable, and adjustably connected through the semi-rigid surface by screws. The shoulder harness is vertically adjustable and swivels to accommodate different shoulder widths. The suspension system's waist harness is removable, and rigidly connected through the semi-rigid surface by screws. The waist harness provides optimum weight transfer onto the hips and creates an air gap, providing ventilation to the back. By removing the frame and placing a cover on it, a seat is formed. By aligning the seat linearly with additional feet, and inserting elongated rails between them, a frame for a cot is formed.

9 Claims, 11 Drawing Sheets

BACKPACK FRAME, SUSPENSION, SEAT AND COT

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The present invention relates to a backpack having a semi-rigid panel for attachment and positioning of the suspension system when in trail configuration, that converts into a seat and a cot when in camp configuration.

U.S. Pat. No. 41,418, issued on Feb. 2, 1864 to Granville Abbott, U.S. Pat. No. 4,511,071, issued on Apr. 16, 1985 to Richard Curran, and U.S. at. No. 4,538,750, issued on Sep. 3, 1985 to Kenneth Hanna, teach backpacks that convert into a litter or cots. However, none of these backpacks teach a suspension or includes a frame that can be converted into a seat.

U.S. Pat. No. 2,316,456, issued on Apr. 13, 1943 to E. C. Robes, Jr., 2,964,222, issued on Dec. 13, 1960 to Ormon Rainwater, U.S. Pat. No. 2,973,888, issued on Mar. 7, 1961 to Harold Beardsley, U.S. Pat. No. 3,158,299, issued on Nov. 24, 1964 to D. G. Weir et al., U.S. Pat. No. 3,620,428issued on Nov. 16, 1971 to John D. Silverthorne, U.S. Pat. No. 3,730,407, issued on May 1, 1973 to Winfield Russell, U.S. Pat. No. 3,828,992, issued on Aug. 13, 1974 to Joseph Cerchione, U.S. Pat. No. 4,056,857, issued on Nov. 8, 1977 to Reginald Quantz, U.S. Pat. No. 4,694,979, issued on Sep. 22, 1987 to Lee Ables, U.S. Pat. No. 4,883,206, issued on Nov. 28, 1989 to Irvin Miller, U.S. Pat. No. 4,885,812, issued on Dec. 12, 1989 to Charles Lindner, U.S. Pat. No. 4,947,498, issued on Aug. 14, 1990 to Leonardus Van Boxtel, U.S. Pat. No. 4,955,517, issued on Sep. 11, 1990 to Carlo Maresca and U.S. Pat. No. 5,209,381, issued on May 11, 1993 to John Jay, teach backpacks that convert into seats or cots. However, none of these backpacks create a semi-rigid surface on which to mount the suspension system, or has an adjustable suspension system, and all of them differ significantly in geometry from the present invention.

U.S. Pat. No. 3,464,607, issued on Sep. 2, 1969 to Ernest Grace, teaches a backpack frame and suspension. However, it does not create a semi-rigid surface on which to mount the suspension system, and does not convert to a cot on its own (without the use of a second frame).

U.S. Pat. No. 3,885,722, issued on May 27, 1975 to Jerry Robertson and U.S. Pat. No. 3,347,429, issued on Oct. 17, 1967 to H. S. Ruth, Jr., teaches a backpack frame and suspension. However, it does not create a semi-rigid surface on which to mount the suspension system, and it does not convert to a seat or cot.

U.S. Pat. No. 3,912,138, issued on Oct. 14, 1975 to Norman Pava, teaches a backpack frame, suspension and plurality of storage bags or compartments, and it can be converted into a litter. However, it does not create a semi-rigid surface on which to mount the suspension system, it does not convert to a seat, it differs significantly from the present invention in its geometry and is designed for evacuating injured climbers and hikers, not for sleeping in comfort.

U.S. Pat. No. 3,733,017, issued on May 15, 1973 to Murray Pletz, U.S. Pat. No. 3,860,157, issued on Jan. 14, 1975 to Peter Richards, U.S. Pat. No. 4,169,550, issued on Oct. 2, 1979 to Paul Williams teach backpack frames, suspensions and plurality of storage bags or compartments. However, none of these designs create a semi-rigid surface on which to mount the suspension system, and none can be converted to a seat or cot.

U.S. Pat. No. 6,202,907, issued on Mar. 20, 2001 to Richard Higgins, teaches a backpack frame, suspension and plurality of storage bags or compartments, and it can be converted into a cot. However, it does not create a semi-rigid surface on which to mount the suspension system, it does not suggest the use of the frame as a seat, and the geometry of the present invention is significantly different, reducing the number of parts, the weight and cost.

None of the above inventions and patents, taken either singly or in combination, is seen to describe the instant invention as claimed.

BRIEF SUMMARY OF THE INVENTION

The instant invention relates to a backpack which includes a main bag, a suspension system, a frame and additional parts. The frame is enclosed within the main bag to which the suspension system (comprising shoulder and waist harnesses) is attached. The frame is secured in place within the main bag by means of two straps that are fastened in place with side release buckles. The frame when secured provides a semi-rigid surface on which to secure the shoulder and waist harnesses. The frame can be removed from the main bag and can be used as a camp seat.

The camp seat, when used in conjunction with other parts stowed in the backpack, can be configured into a cot. When the camp seat is aligned with two additional secondary feet, and tubes are inserted between them, a frame for a cot is formed. Extenders are added to create additional length. The orientation of the frame is such that when a mattress is placed on the frame and weight is put on the mattress, the forces are directed inwardly, resulting in great stability.

Accordingly, several objects and advantages of the present invention are:

(a) to provide a backpack with a suspension system that combines the best features of external frame backpacks (comfort, provided by good weight transfer onto the hips and air flow to the back) and internal frame backpacks (style);

(b) to provide a backpack with a suspension system that is adjustable to fit a wide range of torsos;

(c) to provide a backpack with a removable suspension system that makes it neater for easy transport or storage;

(d) to provide a backpack having a frame which can be converted into a camp seat;

(e) to provide a backpack having a frame which can be converted into a sleeping cot;

(f) to provide improved elements and arrangements thereof in an apparatus for the purposes described which is inexpensive, dependable and fully effective in accomplishing its intended purposes.

These and other objects of the present invention are achieved in one embodiment of the invention which includes a main bag, a suspension system, a frame and additional parts. The frame is held in place in the main bag by means of two strips of webbing with side release buckles attached to each end that are connected to the main bag. This forms a semi-rigid surface to attach the suspension system, comprised of shoulder and waist harnesses. In another embodiment, the backpack frame, when removed from the main bag, can have a cover added to form a seat and further configured with the additional parts to form a cot.

DETAILED DESCRIPTION OF THE INVENTION

Figure 1A:
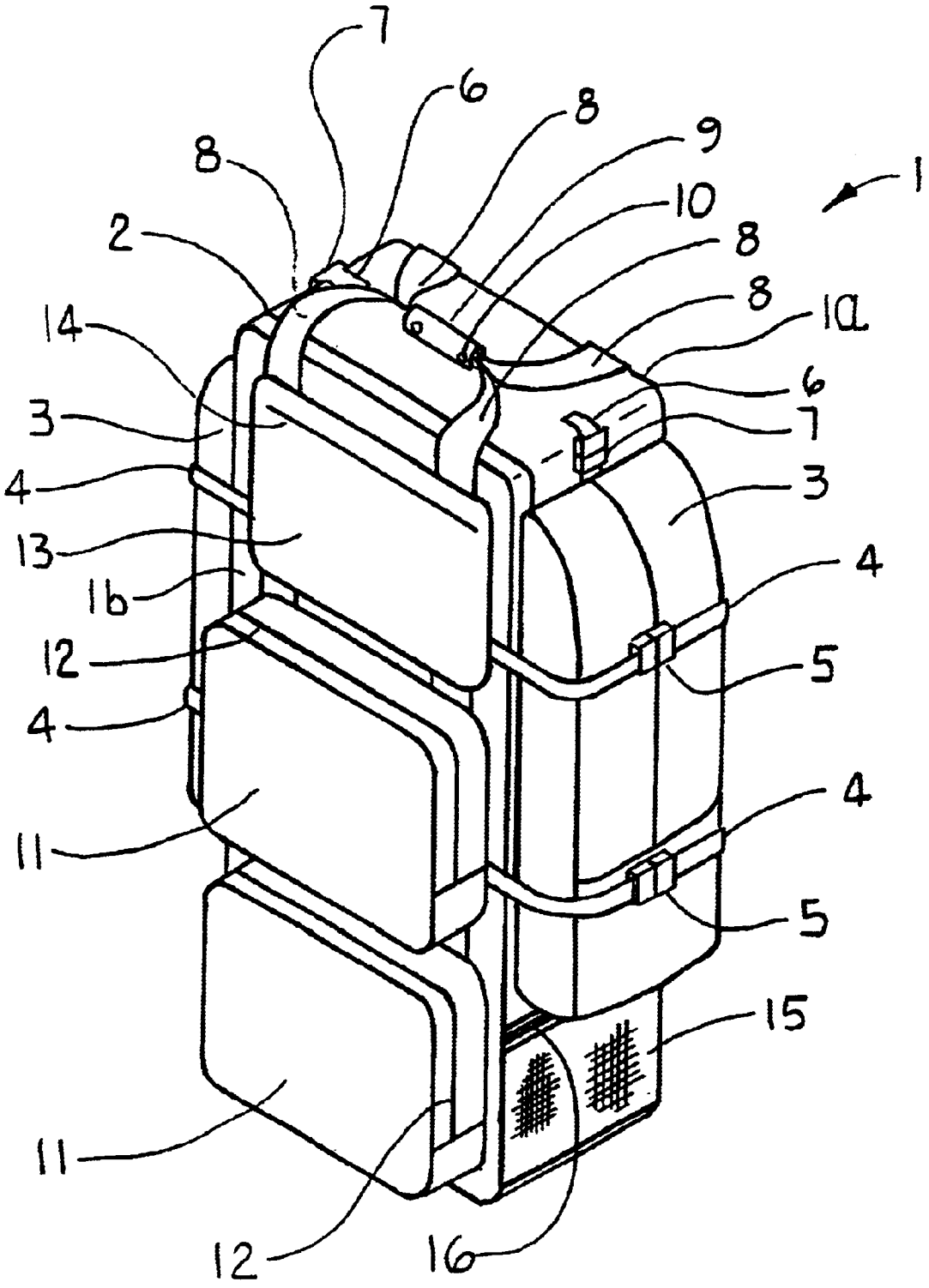
FIG. 1A is a perspective view of the assembled backpack as seen from the front.

Table Of Reference Numerals In Drawings:

| # | ITEM |
|---|---|
| 1 | Main bag |
| 1a | Back Portion |
| 1b | Front Portion |
| 2 | Zipper |
| 3 | Side Bag |
| 4 | Compression Strap |
| 5 | Side Release Buckle |
| 6 | Tension Strap |
| 7 | Side Release Buckle |
| 8 | Cloth Webbing |
| 9 | Handle |
| 10 | Snap |
| 11 | Compartment |
| 12 | Zipper |
| 13 | Top Pocket |
| 14 | Zipper |
| 15 | Mesh Pocket |
| 16 | Zipper |

-continued

Table Of Reference Numerals In Drawings:

| # | ITEM |
|---|---|
| 17 | Shoulder Harness |
| 18 | Waist Harness |
| 19 | Grommet |
| 20 | Load Adjuster |
| 21 | Adjustable Ladder Lock |
| 22 | Waist Bracket |
| 22a | Slot |
| 23 | Sternum Strap |
| 24 | Side Release Buckle |
| 25 | Vertical Stave |
| 26 | Frame |
| 27 | Internal Suspension Strap |
| 28 | Side Release Buckle |
| 29 | Sew Location |
| 30 | Internal Rail |
| 31 | Shoulder Harness Clip |
| 32 | Screw |
| 32a | Hole |
| 33 | Washer |
| 34 | Rivnut |
| 35 | Horizontal Stave |
| 36 | Retaining Ring |
| 37 | Screw |
| 37a | Hole |
| 38 | Washer |
| 39 | Grommet |
| 40 | Rivnut |
| 41 | Retaining Ring |
| 42 | Screw |
| 42a | Hole |
| 43 | Washer |
| 44 | Grommet |
| 45 | Rivnut |
| 46 | Retaining Ring |
| 47 | Waist Harness Strap |
| 48 | 'D' Ring |
| 49 | Side Release Buckle |
| 50 | Fitting |
| 51 | Feet |
| 52 | Seat Cloth |
| 53 | Side Release Buckle |
| 54 | Spanner |
| 55 | Secondary Feet |
| 56 | Extender |
| 57 | Cloth Mattress |
| 58 | Sleeve |
| 59 | Flap |
| 60 | Snap |
| 61 | Tab |
| 62 | Shoulder Strap |
| 63 | Side release buckle |
| 64 | Zipper |

Main Bag:

FIG. 1A shows a main bag 1 that provides front-loading access by means of a zipper 2 that runs up the sides and across the top. The main bag 1 has two primary sides, the back portion 1*a* and the front portion 1*b*.

The main bag 1 has two side bags 3 removably attached to either side of the main bag by means of compression straps 4 and side release buckles 5. The compression straps 4 are configured horizontally and are sewn to the main bag 1. Top tension straps 6 and side release buckles 7 hold the side bags vertically and stop them from slipping out. (Similarly, there are bottom tension straps and side release buckles, which are not shown).

Four other cloth webbings 8, configured vertically, are sewn to the main bag 1 on front portion 1*b* and back portion 1*a* and reinforce the main bag structure. The cloth webbings 8 form a handle 9 at the top that is secured in place by means of snaps 10. The handle 9 is useful in the stowage and carrying of the backpack.

Two compartments 11 attached to the front portion 1*b* provide easy access to items that may be frequently used while backpacking. Zippers 12 are added to provide entry to the compartments. The top pocket 13 provides a flat compartment to stow small items such as a compass and map. A zipper 14 is added to provide entry into the top pocket 13. A mesh pocket 15 is provided on either side of the main bag 1 and closed with a zipper 16 for wet items or used wrappers.

Figure 1B:
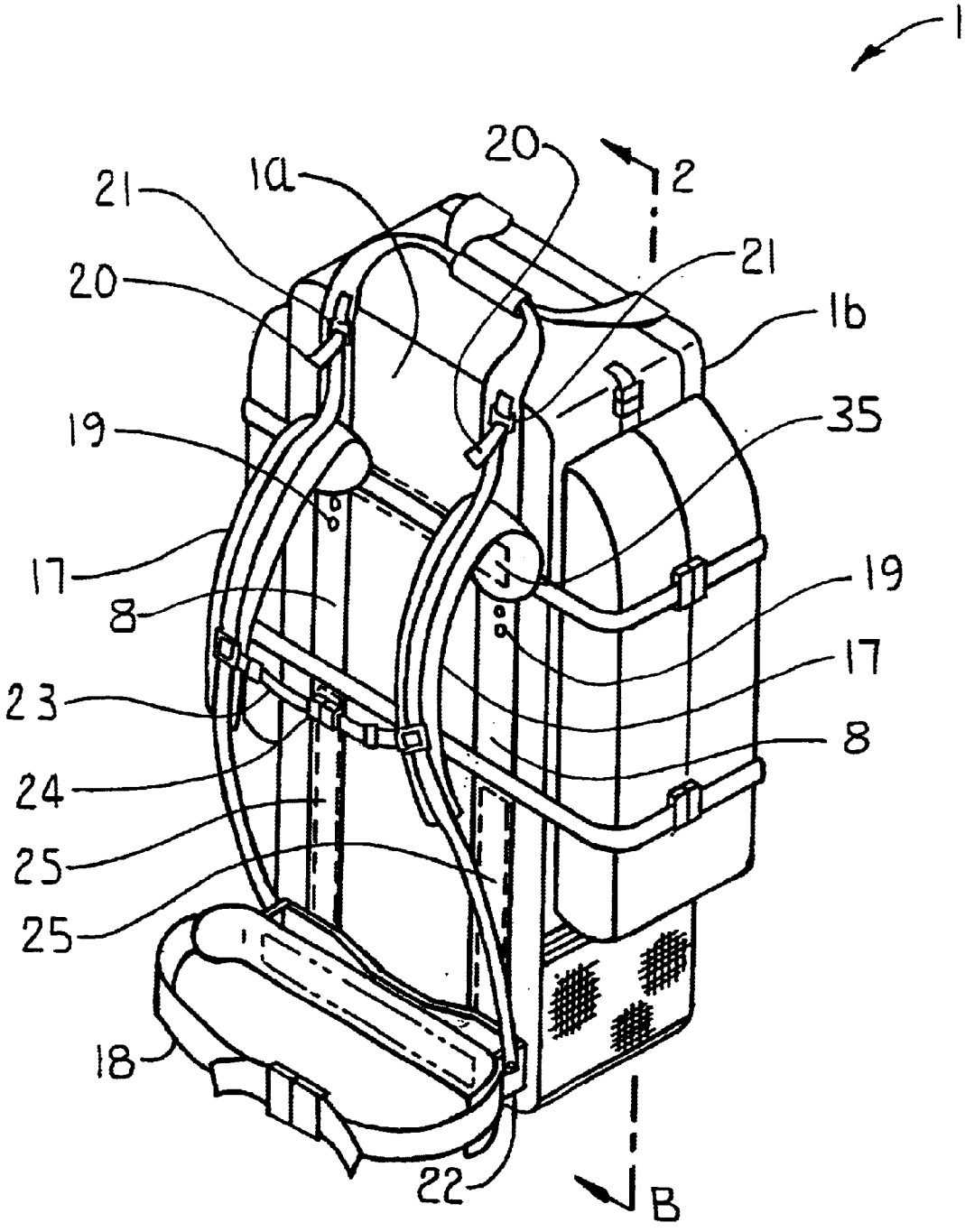
FIG. 1B is a perspective view of the assembled backpack as seen from the back showing the harnesses.

Suspension:

FIG. 1B shows the main bag 1 as viewed from the back to show the placement and attachment of the two shoulder harnesses 17 and waist harness 18 to the back portion 1*a*. The upper ends of the shoulder harnesses are each attached individually by securing each shoulder harness to one of a pair of horizontally aligned sets of grommets 19. This feature enables the shoulder straps to be adjustable for different length torsos. The shoulder harnesses 17, by being independently attached through grommets 19, enable the shoulder harnesses to rotate at the points of attachment. This action enables the wearer to have the shoulder harnesses automatically adjust to the wearer's neck dimensions. (See FIGS. 2B and 2C).

Load adjusters 20 are affixed between the shoulder harnesses 17 and main bag 1 and enable the wearer to adjust the center of gravity by means of adjustable ladder locks 21. The lower ends of the shoulder harnesses 17 are each attached individually to a waist bracket 22. (See FIG. 2D).

A sternum strap 23, affixed to the shoulder harnesses 17 and connected by side release buckle 24, prevents the shoulder harnesses from slipping off the user's shoulders.

The waist harness 18 is attached to main bag by means of waist bracket 22. The waist bracket 22 is secured to vertical staves 25 (see FIG. 2B). The vertical staves 25 are enclosed in a sleeve provided by cloth webbing 8, which prevents the waist bracket 22 from rotating under weight and causing the entire backpack to sag.

Both the shoulder harnesses and the waist harness may be removed from the main bag and stowed within the main bag. This is particularly helpful when traveling to prevent any part of the suspension from being caught in doors or conveyor belts at an airport.

Figure 2A:
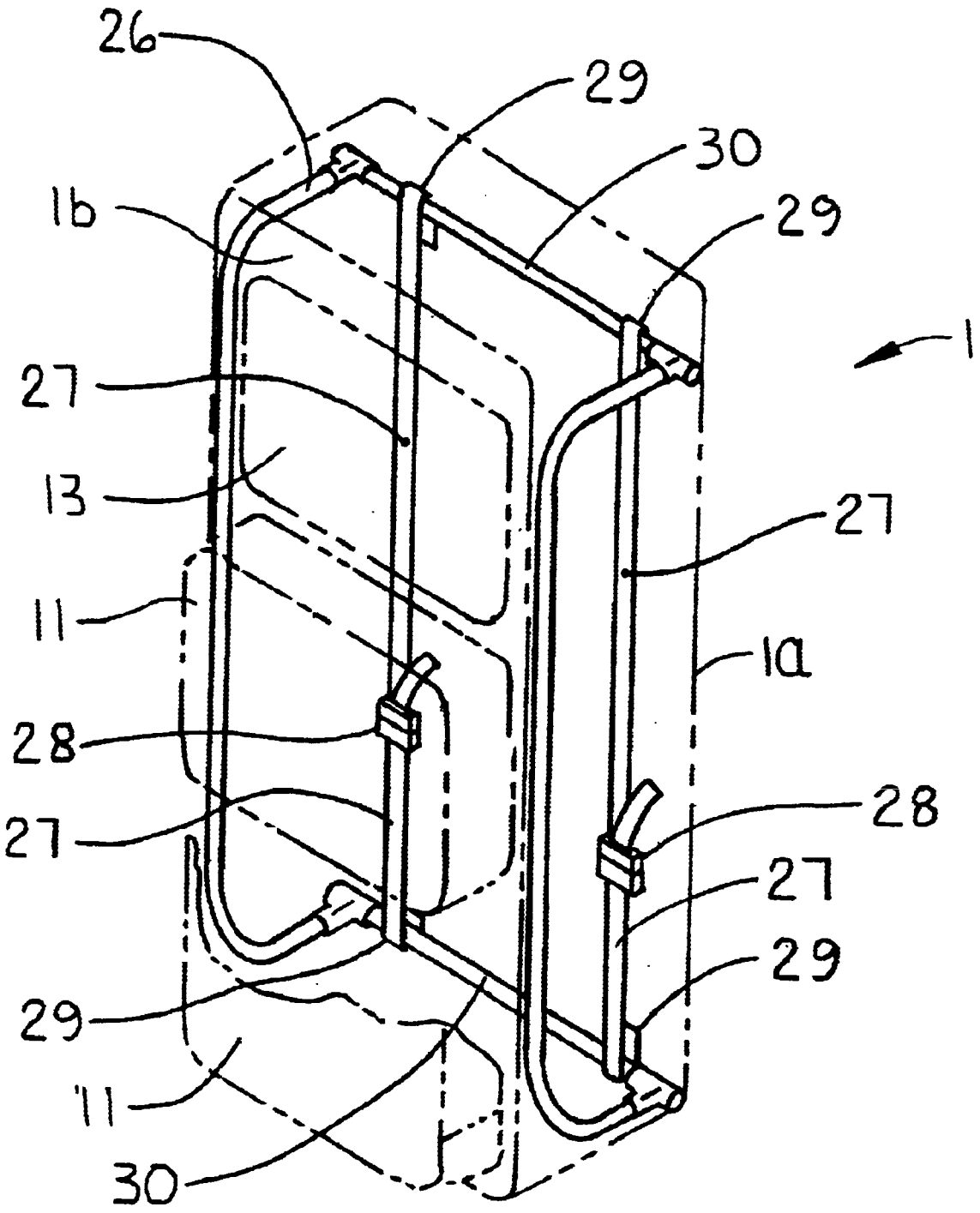
FIG. 2A is a perspective cut-away view of the frame showing the means of placement and attachment to the main bag.

FIG. 2A shows the frame 26 (see FIG. 3A) secured in place by two internal suspension straps 27 and side release buckles 28 (shown in phantom for clarity of orientation are main bag 1, with compartments 11 and top pocket 13). Each suspension strap 27 is sewn in place at two sew locations 29 at the top and bottom of the back portion 1*a* and looped over the horizontal internal rails 30 (upper and lower) of the frame. The remaining ends are clipped together with side release buckles 28 and tightened to form a semi-rigid surface on which to attach the shoulder and waist harnesses on the opposite side.

Figure 2B:
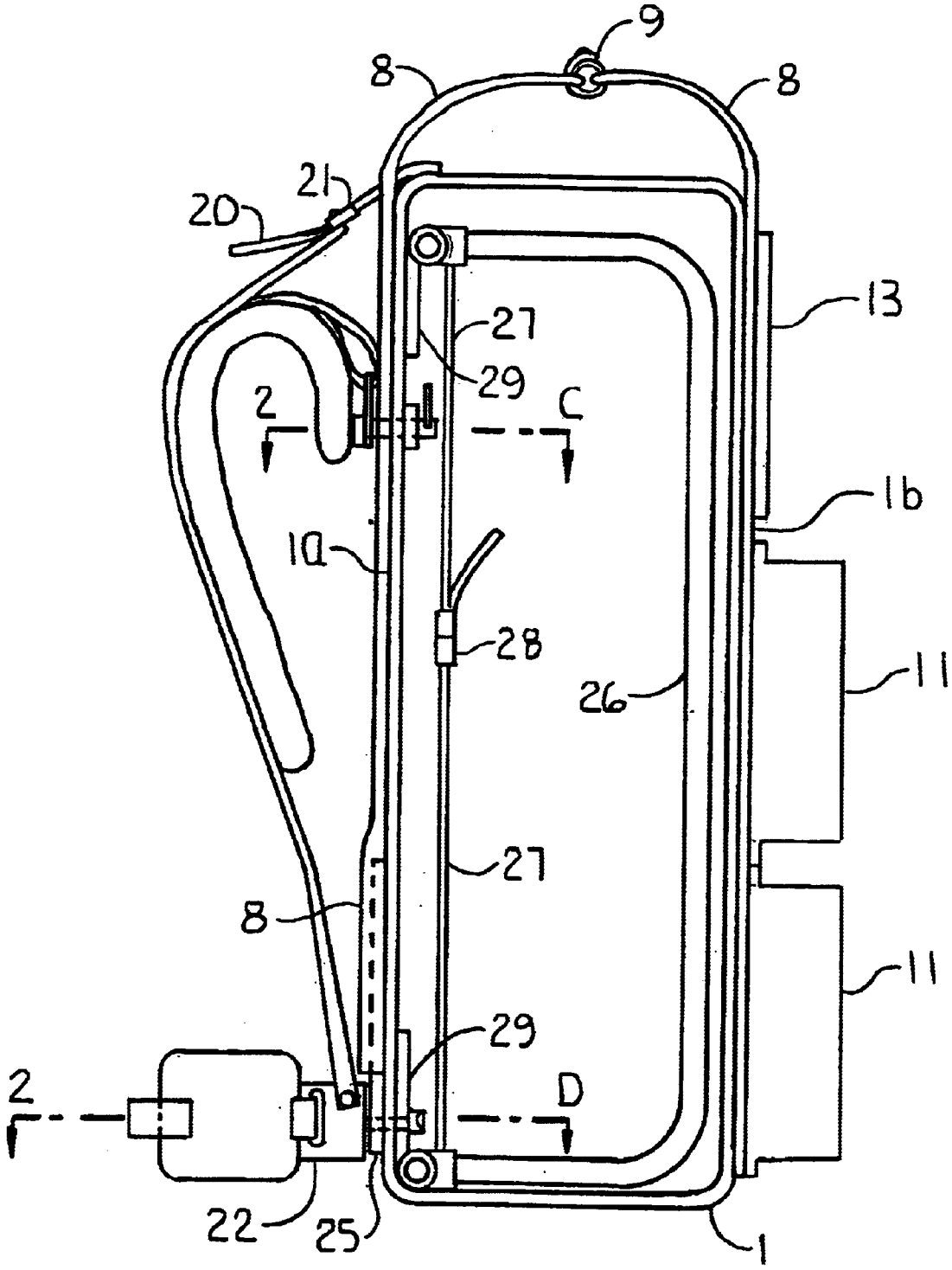
FIG. 2B is a side view of the main bag showing the placement and means of attachment of the suspension to the main bag. (For clarity, the side bag and side portion of the main bag are removed and material thicknesses are exaggerated).

FIG. 2B shows the configuration of the attachment points of the shoulder harnesses 17 and waist harness 18. (The side panel of main bag 1 has been removed for clarity).

Figure 2C:
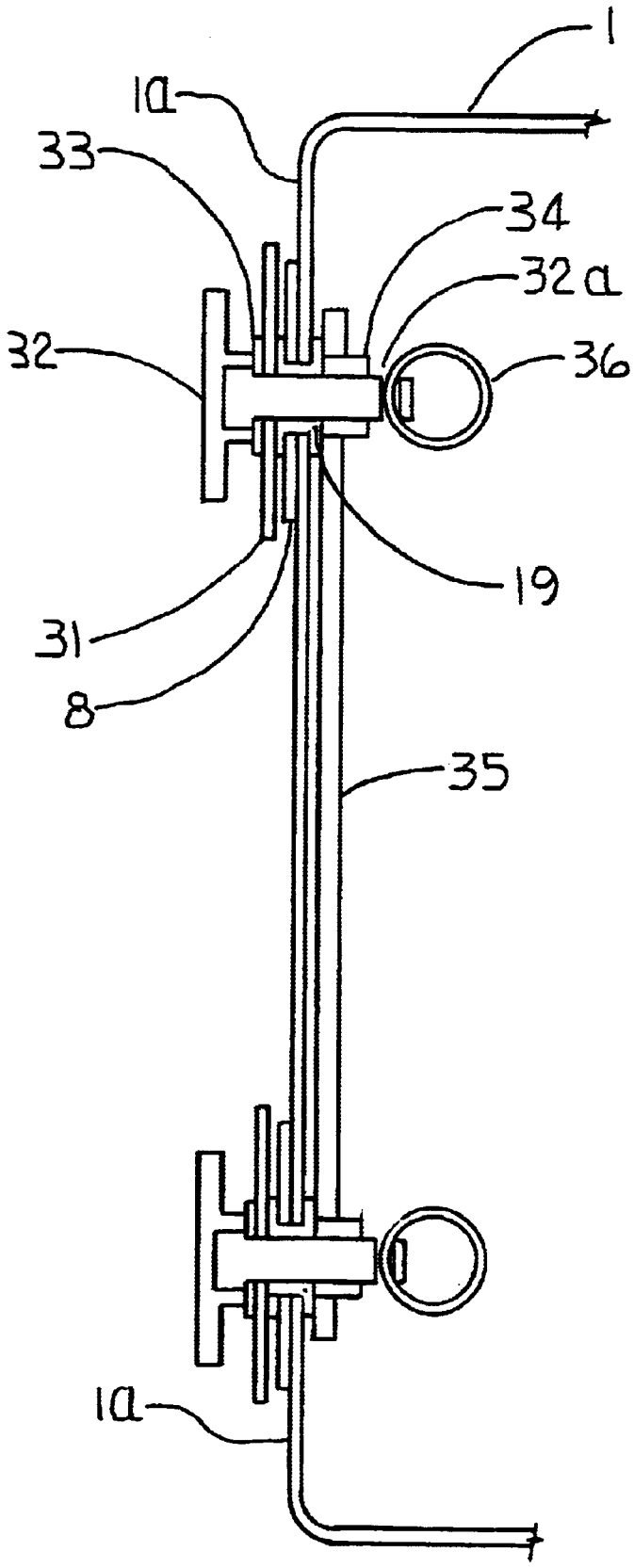
FIG. 2C is a sectional view (taken on line 2-C of FIG. 2B) of the connection of the shoulder harness to the main bag.

FIG. 2C shows the bolting arrangement for the shoulder harness clip 31 (refer to FIG. 2B). A screw 32 with a hole 32*a* drilled in the end passes through washer 33, shoulder harness clip 31 and grommet 19 that is connected to the main bag 1, and is threaded into a rivnut 34, which is secured to the horizontal stave 35. A retaining ring 36 is installed in hole 32*a* to prevent the screw 32 from backing out. The resulting connection, being fixed in the horizontal stave 35, prevents the shoulder harnesses 17 from creeping inward. (The lower ends of the shoulder harnesses 17 connect to waist bracket 22 as shown on FIG. 2D).

Figure 2D:
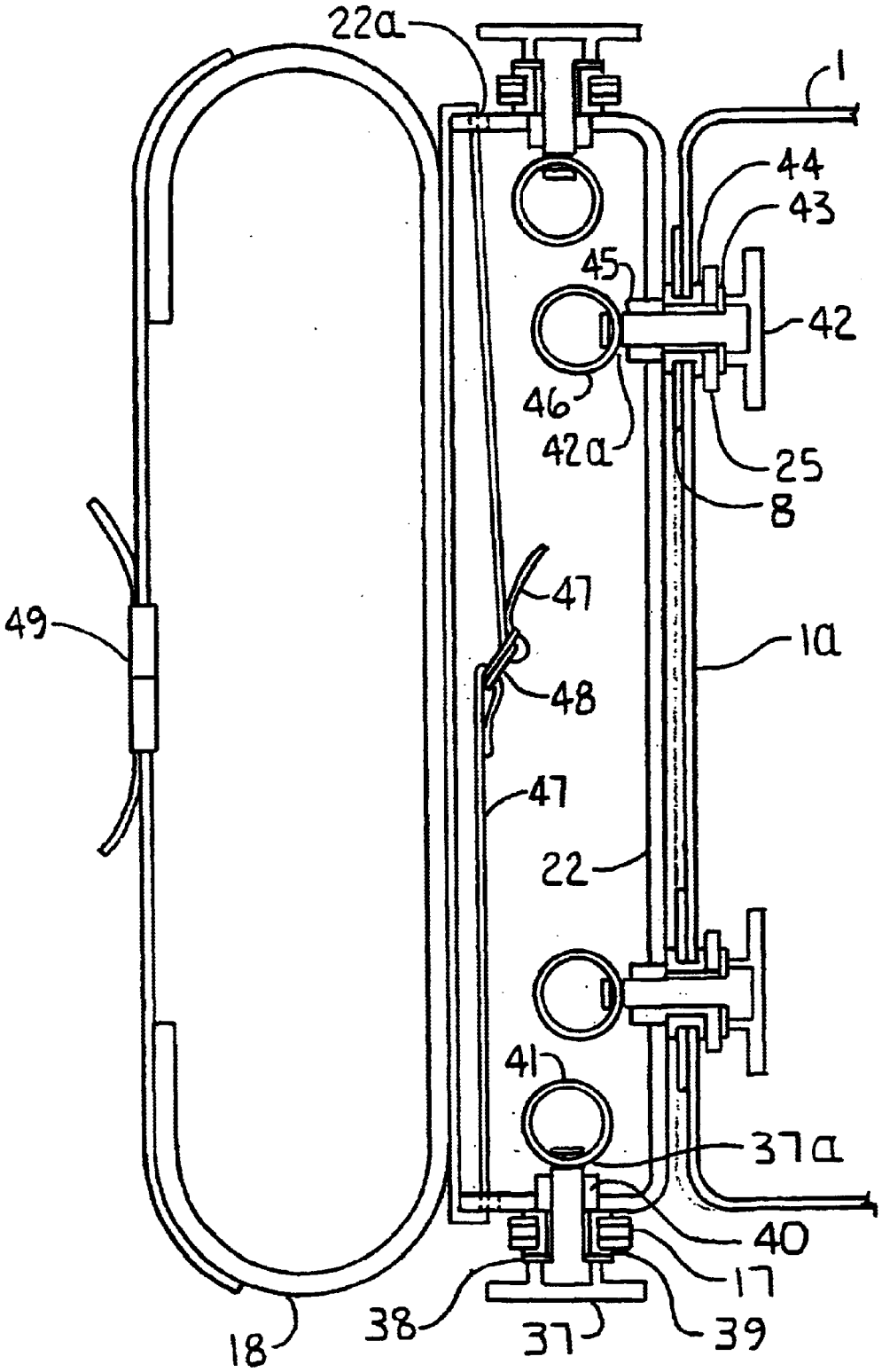
FIG. 2D is a sectional view (taken on line 2-D of FIG. 2B) of the connection of the waist harness to the main bag.

FIG. 2D shows a sectional view of the bolting of the lower ends of shoulder harnesses 17, waist bracket 22 and waist harness 18.

The lower ends of the shoulder harnesses 17 are connected to the waist bracket 22 by inserting a screw 37 (with a hole 37*a* drilled in the end) through a washer 38 and a grommet 39 that is connected to each shoulder harness 17. The screw 37 is then threaded into a rivnut 40 that is secured to the waist bracket 22. Screw 37 is then prevented from unthreading by inserting a retaining ring 41 through the drilled hole 37*a*.

The waist bracket 22 is attached to main bag 1 at two places. Screw 42 with a hole 42*a* drilled in the end is placed through a washer 43, vertical staves 25, and a grommet 44 which is connected to the main bag 1, and is threaded into a rivnut 45 which is secured to the waist bracket 22. Screw 42 is then prevented from unthreading by inserting a retaining ring 46 through the drilled hole 42*a*.

The connection of the waist harness 18 to the waist bracket 22 is achieved with a waist harness strap 47 which has on one end 'D' rings 48 that pass through slots 22*a* in the sides of the waist bracket 22 and secure the ends of the waist harness strap 47 together. The waist harness 18 then passes around the wearer and clips together using a side release buckle 49 that can be adjusted to accommodate different waist sizes.

Figure 3A:
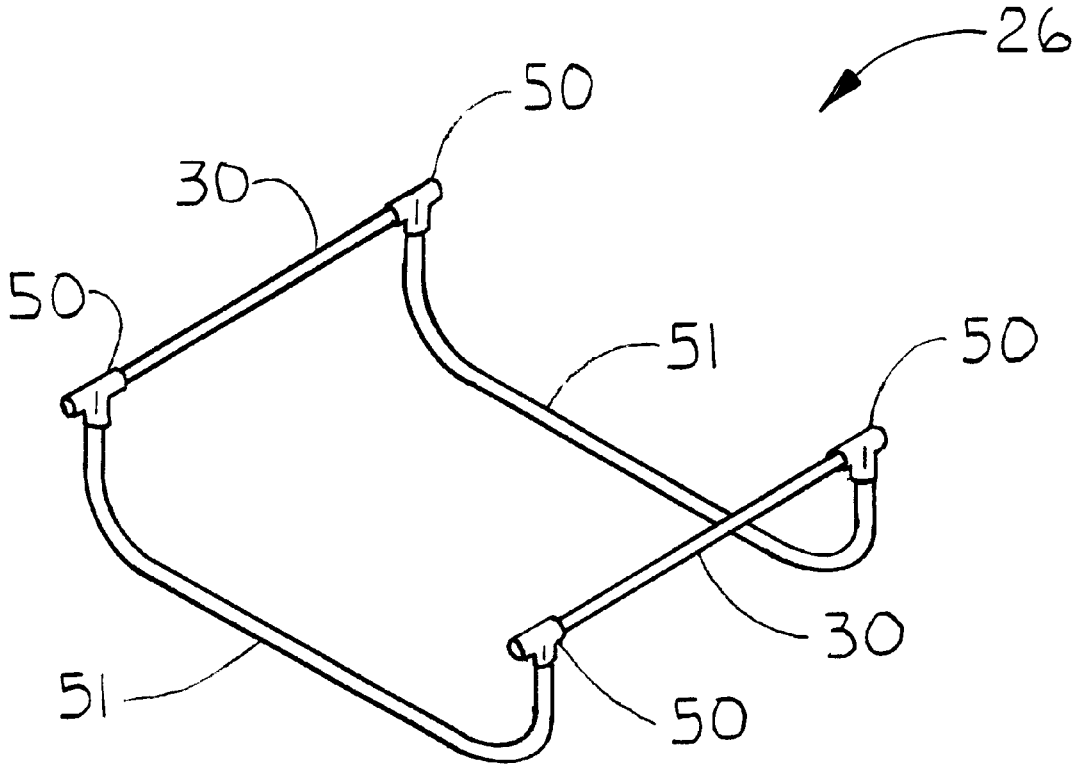
FIG. 3A is a perspective view of the frame removed from the main bag.

Seat:

FIG. 3A shows the frame 26 when it is removed from the main bag. Internal rails 30 are press-fitted into fittings 50 and secured into place by means of glue and rivets (not shown). Similarly, the feet 51 are secured to fittings 50. The result is a very strong assembly.

Figure 3B:
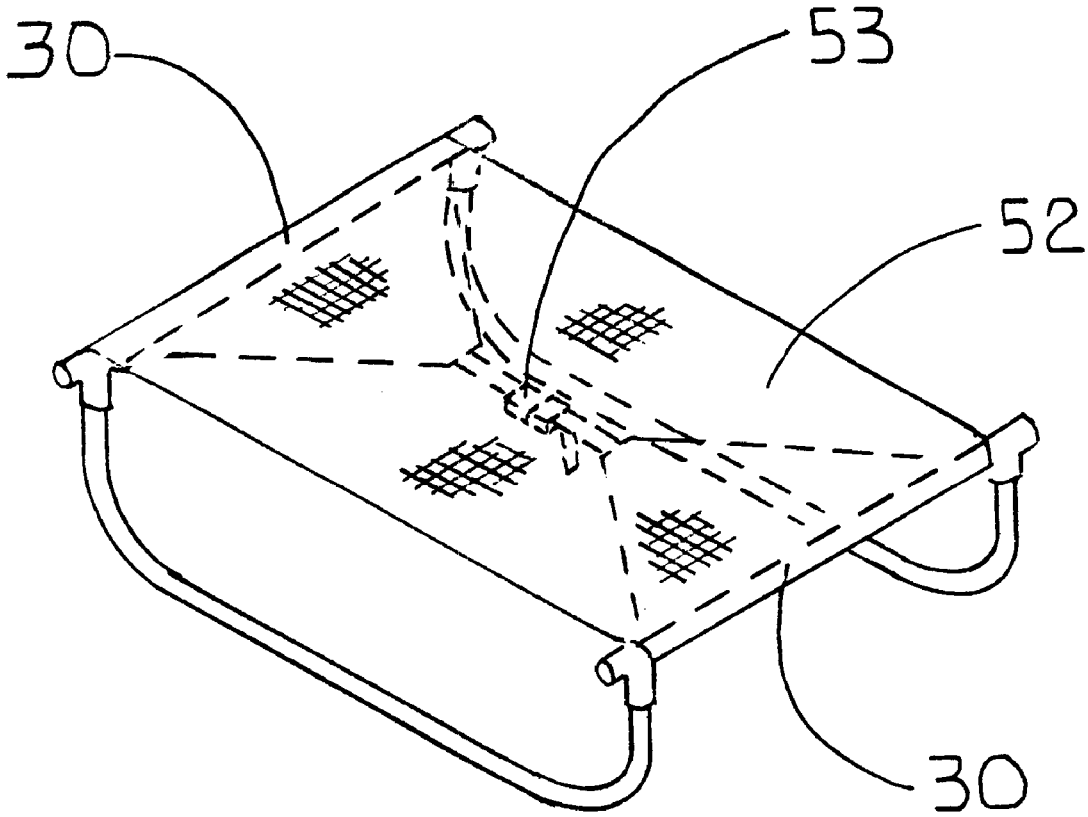
FIG. 3B is a perspective view of the frame with the seat cover installed.

FIG. 3B shows the seat cloth 52. Each end of the seat cloth 52 is wrapped around and underneath internal rails 30, and clipped together using a side release buckle 53.

Figure 4A:
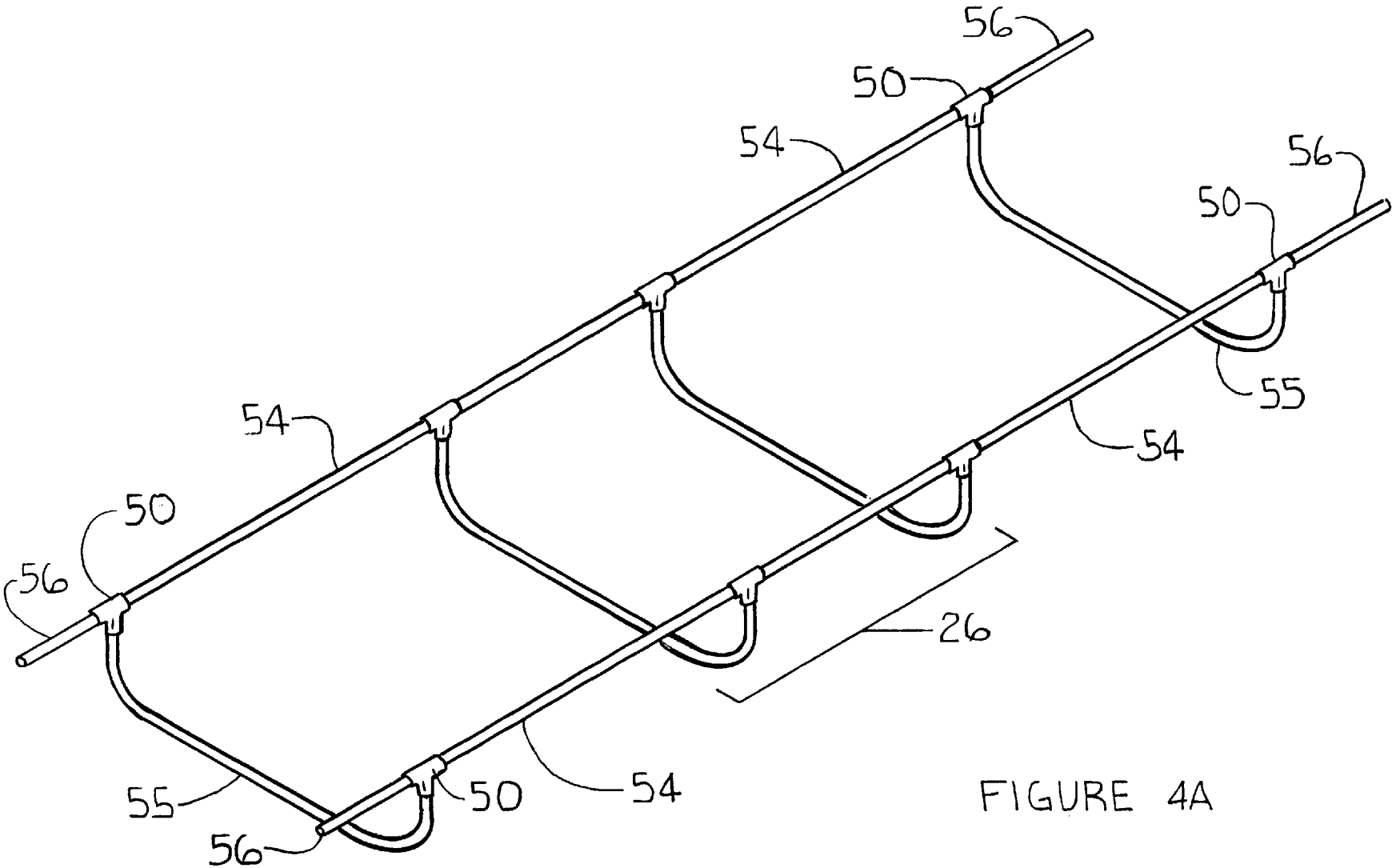
FIG. 4A is a perspective view of the frame assembled with additional parts when it is to be used as a cot.

Cot:

FIG. 4A shows the frame 26 when arranged in a cot configuration. The frame 26 is placed in the middle of the structure. Using four spanners 54 (made of tubes), two secondary feet 55 (permanently attached to fitting 50) and four extenders 56 (made of tubes), the parts are assembled to form the cot frame. These additional parts are stowed in the main bag 1 (not shown).

Figure 4B:
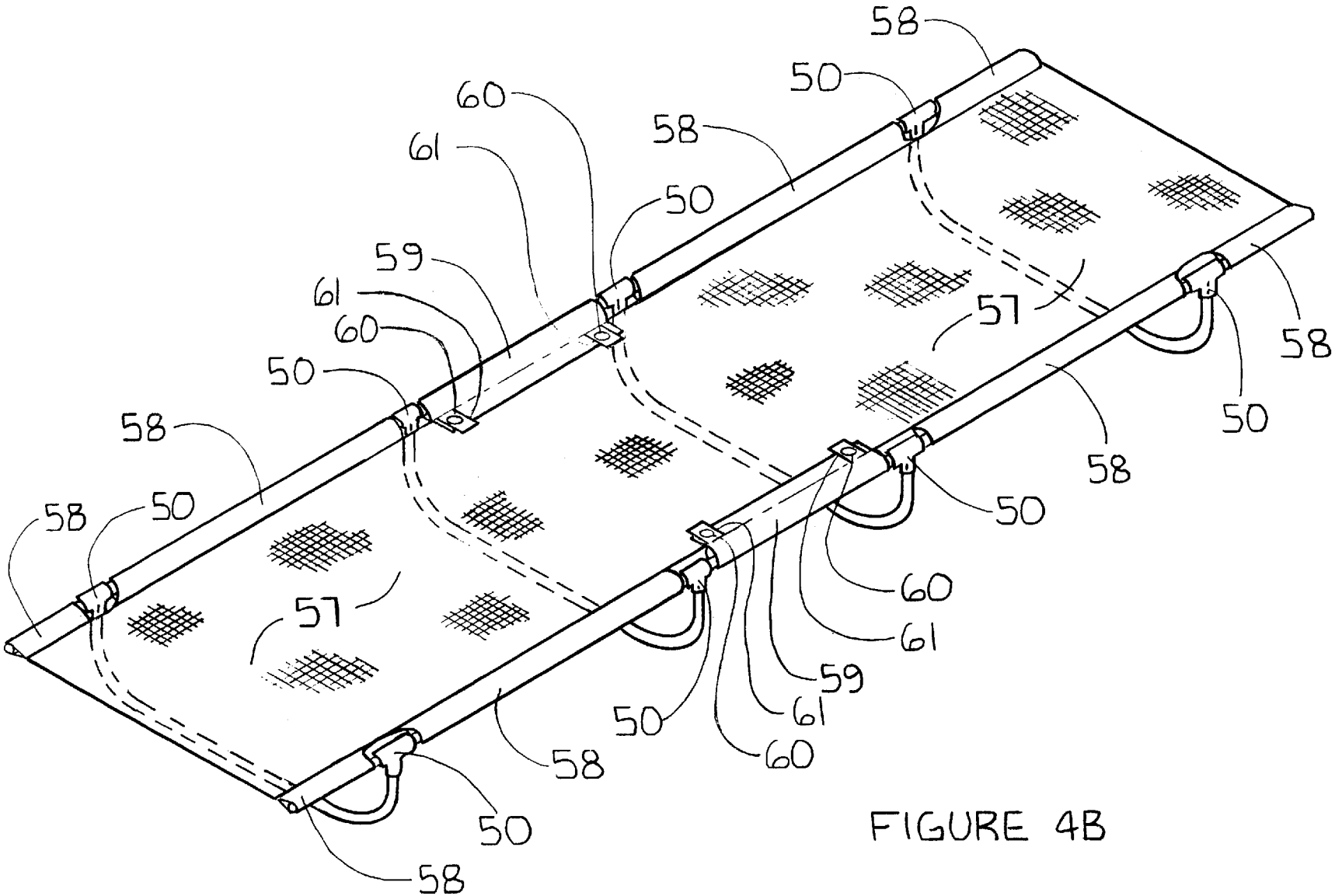
FIG. 4B is a perspective view of the cot with the cloth mattress installed.

FIG. 4B shows the cot frame with the cloth mattress 57 attached. The spanners 54 (hidden from view) and extenders 56 (hidden from view) are fed through sleeves 58 and inserted into the fittings 50. The flaps 59 are wrapped over the internal rails 30 (hidden from view) and attached using snaps 60 in four places (two each side). Tabs 61 enable the snaps 60 to be easily released.

Figure 5B:
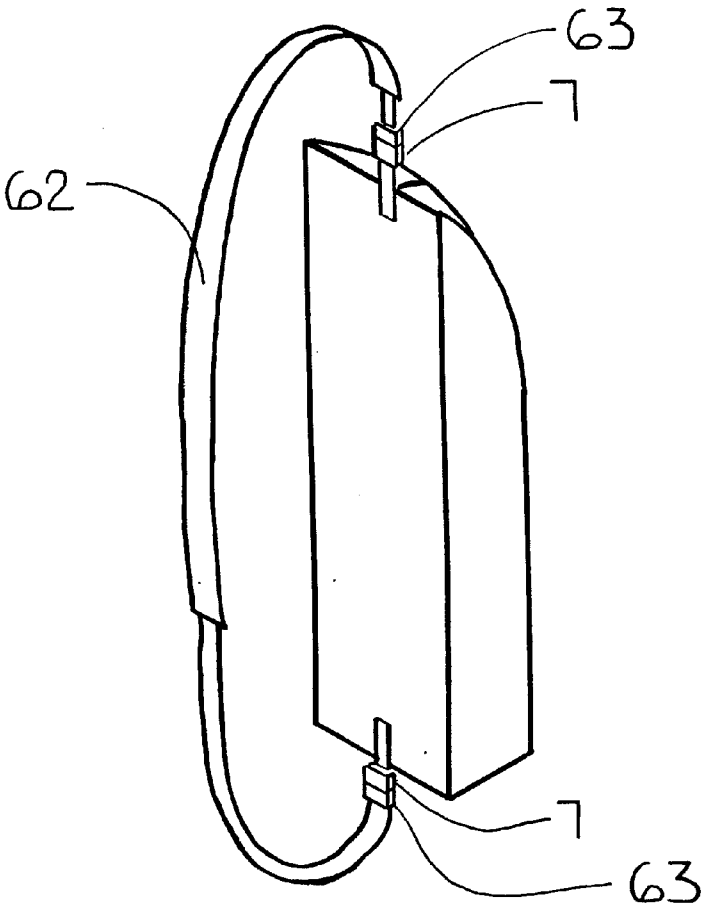
FIG. 5B is a perspective view of a side bag removed and a strap added, as viewed from the back.
Figure 5A:
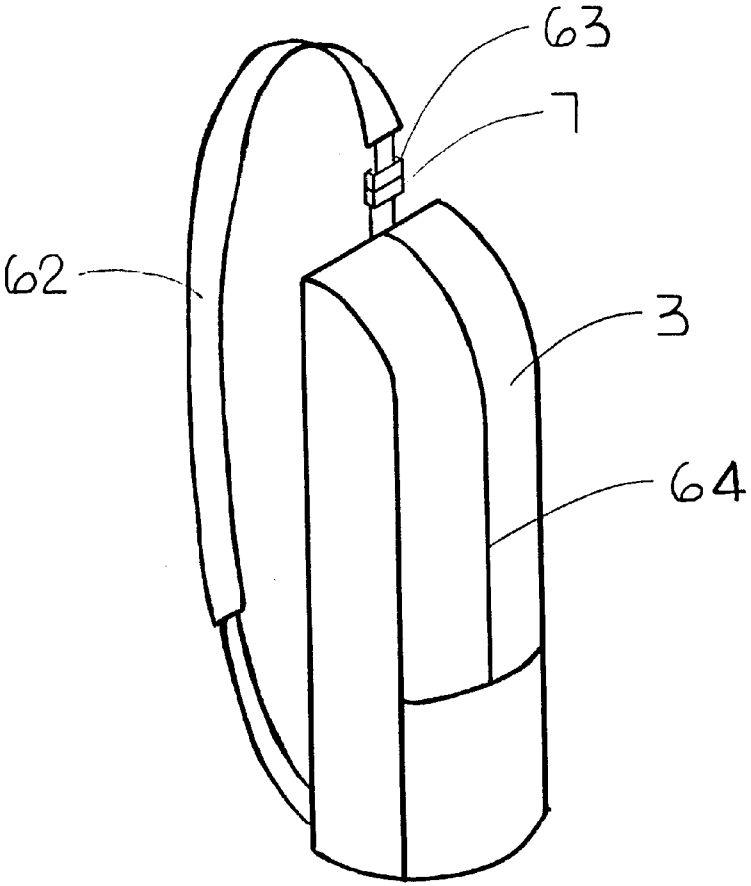
FIG. 5A is a perspective vies of a side bag removed and a strap added, as viewed from the front.

Side Bags:

FIG. 5A shows one of the side bags 3 that is removed from the main bag 1. A shoulder strap 62 is attached to either side bag 3 at the top and bottom using side release buckle 63, and is used to tote items independently of the main bag. (Side release buckle 7 is permanently attached to side bags 3). The shoulder strap 62 is long enough that it can be worn around the waist to form a pack secured at either the front or the back of the wearer. It may also be used to carry items over the shoulder or back. A zipper 64 provides access into the side bag 3.

FIG. 5B shows the side bag as viewed from the back.

CONCLUSION, RAMIFICATIONS, AND SCOPE

Accordingly, the reader will see that the backpack of this invention has many advantages:

It includes an inner frame that provides a semi-rigid surface on which to secure the outer shoulder and waist harnesses. Such a suspension system is comprised of components that are internal and external to the main bag. This means that the backpack can be styled to look like other popular internal frame backpacks on the market, yet it retains the benefits of external frame backpacks, which includes good weight transfer onto the hips for better comfort and fit, and a gap which provides ventilation to the back.

It provides a suspension system that can be made highly adjustable, for people of many different sizes and shapes.

It provides a suspension system that is removable, making it easier to transport and store.

It provides a front-loading design, making it easier to pack, organize and find things while trekking.

It can quickly provide a comfortable seat.

It can easily be converted into a comfortable and stable sleeping cot.

Although the description above contains many specifics, these should not be construed as limiting the scope of the invention but as merely providing illustrations of some of the presently preferred embodiments of this invention. For example:

The vertical stiffening means could be a different shape frame, such as a flat rectangle, which would also create a frame for a ladder.

The main bag could have pockets of different shapes or sizes sewn on the front or sides, and different types of straps added on the top, bottom or sides for securing additional or specialized gear.

The angles of the feet could be made bigger or smaller, changing the stability and weight. Different materials could be used for the feet and extension rails, including aluminum, carbon-reinforced plastic and plastic-injection moldings.

If the cot were strengthened, it could be used as an emergency stretcher for rescuing people (ie. using the backpack to carry medical supplies, and converting to a cot if needed to remove an injured person).

Thus the scope of the invention should be determined by the appended claims and their legal equivalents, rather than by the examples given.

What is claimed is:

1. In a backpack system for hikers and campers having a main storage compartment, a suspension system and a convertible frame, the combination comprising:

(a) a flexible fabric main bag, having a back portion adapted to be positioned adjacent to the hiker's back, said back portion having a top edge to be positioned adjacent to the hiker's neck and a bottom edge to be positioned adjacent to the hiker's waist; side, top and bottom portions secured about said back portion, and a front portion secured to at least one of said side, top and bottom portions, opposite said back portion to form a flap;

(b) vertical stiffening means, comprising a frame made of a pair of vertically oriented C-shaped members joined adjacent to the open ends thereof by a pair of cross members;

(c) attachment means, comprising a pair of straps fixed to the top edge and bottom edge, respectively, of said back portion, having releasible fastening means on at least one end of one strap of each pair of straps, fastened around said cross members of said vertical stiffening means when positioned within said fabric main bag, to form a semi-rigid surface back portion; and (d) adjustably fixed shoulder suspension members and fixed waist suspension member secured to the outside of said semi-rigid surface back portion adjacent to the top and bottom respectively of said semi-rigid surface back portion.

2. The invention as claimed in claim 1 wherein said shoulder suspension member includes a pair of shoulder harnesses; and said back portion includes two sets of mounting means, vertically spaced apart and formed in said back portion, each said set for receiving one end of each of said shoulder harnesses.

3. The invention as claimed in claim 2 further including a horizontal stiffener engaging at the ends thereof with said shoulder harnesses when fixed in said mounting means said back portion, whereby said attached shoulder harnesses are held in spaced apart relationship during use of said backpack.

4. The invention as claimed in claim 1 further including a pair of narrow vertical web fabric reinforcing members secured to said main bag back portion, each having a top and a bottom; and said mounting means comprising two sets of holes, supported by grommets, aligned along said vertical web fabric reinforcing members adjacent the tops thereof.

5. The invention as claimed in claim 1, further including a seat fabric member secured about said frame, to form a seat.

6. The invention as claimed in claim 1 further including a plurality of spanner, extenders, secondary feet and an elongated fabric member, assembled with said frame to form a sleeping cot.

7. In a backpack for hikers and campers having a main storage compartment, a suspension system and a convertible frame, the combination comprising:

(a) a flexible fabric main bag, having:

(i) a back portion, having a top horizontal edge and a bottom horizontal edge, adapted to be positioned adjacent to the hiker's back;

(ii) side, top and bottom portions secured about said back portion, and a front portion secured to at least one of said side, top and bottom portions, opposite said back portion to form a flap;

(iii) a pair of narrow vertical web fabric reinforcing members secured to said main bag back portion, spaced apart, each having a top and a bottom;

(iv) two sets of vertically adjustable mounting means comprising two sets of holes, supported by grommets, aligned along, said vertical web fabric reinforcing members adjacent the tops thereof and formed in said reinforcing members, each set for receiving one end of each said shoulder harnesses;

(v) a horizontal stiffener, positioned adjacent to said one horizontal edge of said back portion and engaging at the ends thereof with said shoulder harnesses when fixed in said mounting means in said back portion, whereby said attached shoulder harnesses are held in spaced apart relationship during use of said backpack;

(vi) a pair of straps fixed to the top horizontal edge and bottom horizontal edge, respectively, of said back portion, having releasible fastening means on at least one end of one strap of each pair of straps;

(b) a frame, comprising a pair of vertically oriented C-shaped members joined adjacent to the open ends thereof by a pair of cross members;

(c) each of said pair of straps being engaged with said frame, when positioned within said fabric main bag and aligned within said pair of straps, to form said main bag portion into a semi-rigid surface; and (d) shoulder and waist suspension members adjustably fixed to the outside of said semi-rigid surface back portion adjacent the top horizontal edge and bottom horizontal edge respectively of said semi-rigid surface back portion.

8. The invention as claimed in claim 7, further including a seat fabric member, used in conjunction with said frame, to form a seat.

9. The invention as claimed in claim 7, further including a plurality of spanners, extenders, secondary feet and an elongated fabric member, assembled with said frame to form a sleeping cot.

* * * * *